US005927488A

United States Patent [19]

Gray

[11] Patent Number: 5,927,488

[45] Date of Patent: Jul. 27, 1999

[54] CIGARETTE PAPER DISPENSER

[76] Inventor: Keith W. Gray, 674-A Morse Ave., Sunnyvale, Calif. 94086

[21] Appl. No.: 09/028,852

[22] Filed: Feb. 24, 1998

[51] Int. Cl.[6] ..... B65D 69/00; A24F 15/00

[52] U.S. Cl. ..... 206/237; 206/242; 206/256; 221/46; 221/34; 221/61; 221/63; 221/99

[58] Field of Search ..... 206/237, 242, 206/256; 221/34, 45, 46, 63, 61, 97, 98, 99, 101, 102

[56] References Cited

U.S. PATENT DOCUMENTS

| | | | |
|---|---|---|---|
| 1,193,427 | 8/1916 | Rose | 206/242 |
| 1,413,391 | 4/1922 | Clark | 206/242 |
| 1,996,749 | 4/1935 | Crosley | 206/242 |
| 2,082,765 | 6/1937 | Krueger | 221/45 |
| 2,202,322 | 5/1940 | Scull | 206/237 |
| 2,514,612 | 7/1950 | Snow | 221/46 |
| 2,567,218 | 9/1951 | Lemire | 206/242 |
| 2,831,571 | 4/1958 | Erbel | 206/237 |
| 3,221,928 | 12/1965 | Horn | 221/98 |
| 3,986,479 | 10/1976 | Bonk | 221/63 |
| 3,994,417 | 11/1976 | Boedecker | 221/63 |
| 4,946,031 | 8/1990 | Confalonieri | 206/38 |
| 4,997,082 | 3/1991 | Durocher | 206/204 |
| 5,011,008 | 4/1991 | Baker | 206/242 |
| 5,325,992 | 7/1994 | Koller et al. | 221/63 |

*Primary Examiner*—William E. Terrell
*Assistant Examiner*—Joe Dillon, Jr.
*Attorney, Agent, or Firm*—Kevin H. Fortin, Esq.

[57] ABSTRACT

A rolling paper dispenser includes a cover defining an inner periphery, an inlet, and an outlet. The inlet is sized to receive the booklet of rolling paper. The outlet is configured to dispense individual rolling papers from the booklet of rolling paper. When the inlet receives a rolling paper booklet, the enclosure holds a rolling paper booklet by the edges of the booklet. Preferably, the rolling paper booklet is held by an inner rim integrated with the inner periphery of the enclosure. The inner rim is precisely sized to hold a booklet of rolling paper in a press-fit.

8 Claims, 2 Drawing Sheets

CIGARETTE PAPER DISPENSER

FIELD OF THE INVENTION

This invention relates to cigarette paper dispensers and particularly to such dispensers which hold cigarette paper and tobacco.

BACKGROUND OF THE INVENTION

In 1838, a French craftsman named John Bardou came up with the idea for a booklet of rolling papers made of thin, pure rice paper. The booklets were a success, and continue to be sold worldwide. "Cigarette paper" and "rolling paper" are commonly interchangeable terms.

Rolling paper booklets typically include a thin cardboard enclosure. The enclosure has an opening to allow individual sheets of rolling paper to extend outward from the opening. The rolling paper is readily gripped and typically pulled from the enclosure one at a time.

One drawback to the rolling paper booklets is that, because of the thin size, such booklets may be easily lost. Additionally, rolling paper booklets may be crushed or the rolling paper may be damaged by liquid spills and the like. What is desired is a way of protecting rolling papers from damage.

For many, it is desirable to keep the rolling papers and tobacco together. This insures that neither the tobacco nor the rolling papers will become lost. Having the tobacco and rolling papers together eliminates the necessity of pre-rolling cigarettes and insures freshness associated with a just-rolled cigarette. Many smokers relax wile rolling a cigarette. Rolling cigarettes can desirably prolong a smoke break.

Tobacco is often sold in a bag, pouch or tin. Rolling papers may also be held in such a pouch or tin. Tins, and pouches are not always convenient. On some occasions, such container may be bulky, having a greater tobacco capacity than one wishes to carry throughout the day. In the case of a pouch, the rolling papers may be crushed or damaged. What is desired is a convenient way of holding and dispensing rolling papers and tobacco together. Further desired is a way of protecting rolling paper booklets.

SUMMARY OF THE INVENTION

A rolling paper dispenser includes a cover defining an inner periphery, an inlet, and an outlet. The inlet is sized to receive the booklet of rolling paper. The outlet is configured to dispense individual rolling papers from the booklet of rolling paper. The rolling paper booklet has edges. When the inlet receives a rolling paper booklet, the enclosure holds a rolling paper booklet by the edges of the booklet. Preferably, the rolling paper booklet is held by an inner rim integrated with the inner periphery of the enclosure. The inner rim is precisely sized to hold a booklet of rolling paper in a press-fit.

The dispenser includes an outer rim extending outwards from the cover. The outer rim has a generally uniform thickness for slidably engaging and covering a box.

The shape of the inner rim can very greatly, however, the preferred shape of the inner rim extends fully along the inner periphery in a generally rectangular pattern. This rectangular pattern maximizes the surface area of the inner rim to optimize the press-fit between the booklet and the rim.

According to one aspect of the invention, the inner rim and outer rim lie co-planar so that the outer rim and inner rim provide rigidity to each other and to the enclosure. This co-planar arrangement inhibits flexion of the dispenser when the dispenser holds a booklet of rolling paper and when the dispenser covers a box.

According to another aspect of the invention, the enclosure has a top and a bottom. The inner rim and the outer rim are adjacent the bottom. The outlet is adjacent the top. The inlet is at the bottom to enable the booklet of rolling papers to enter into the enclosure through the bottom. Preferably, the inlet has an area of less than 6 square inches. More preferably, the inlet is rectangular in shape, having a width of between 1" and 2" and a length of between 2" and 3".

DETAILED DESCRIPTION

Figure 1:
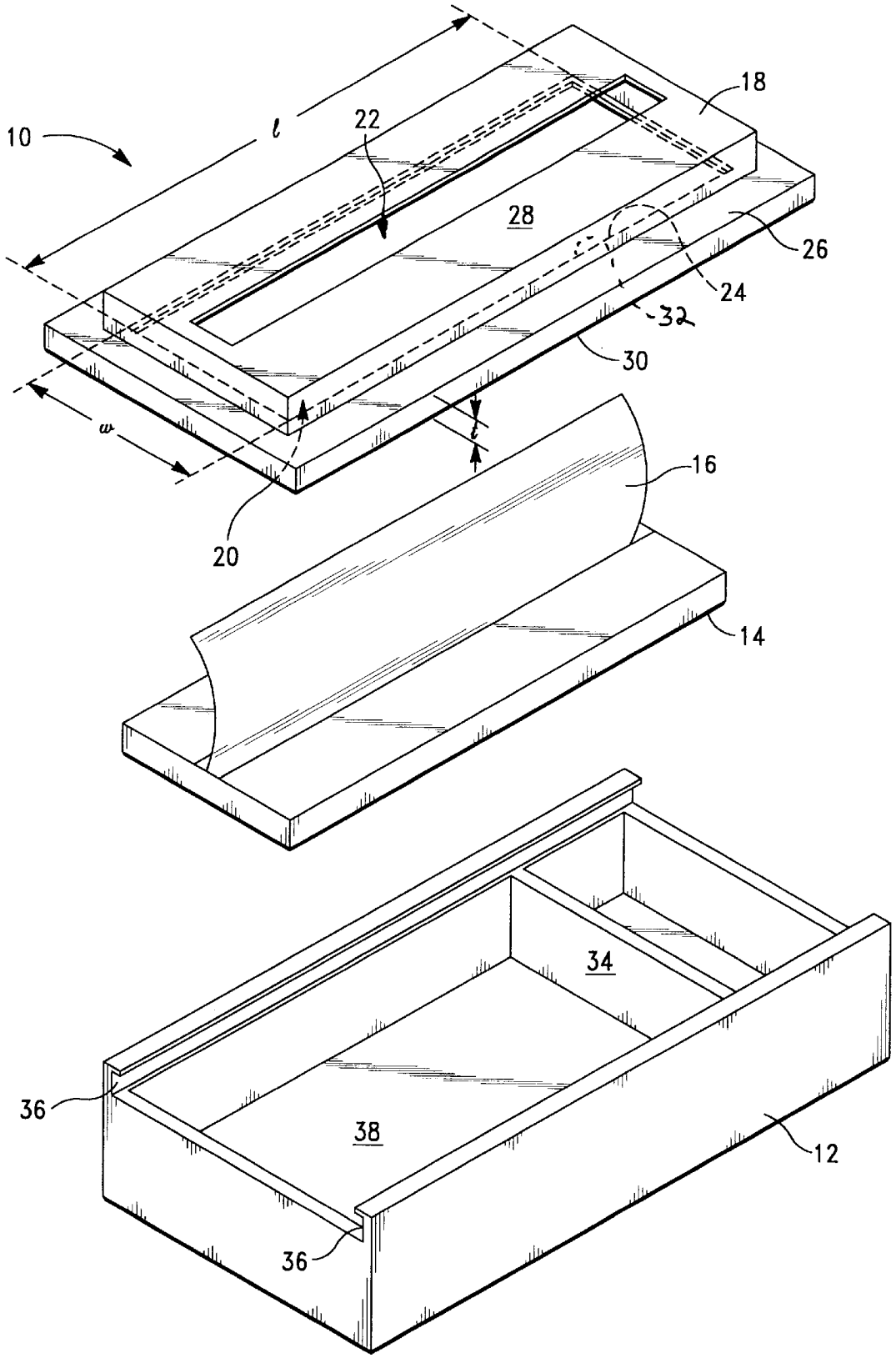
FIG. 1 is an exploded perspective view of a rolling paper dispenser in accordance with the present invention.

FIG. 1 shows a rolling paper dispenser 10. The rolling paper dispenser 10 includes a cover 18 and a box 12. The cover 18 can be used as a stand alone rolling paper dispenser, or may be used in conjunction with the box 12. In any case, the dispenser 10 holds and dispenses rolling paper 16 from a booklet 14 of rolling papers.

The cover 18 has a top 28 and a bottom 30. The bottom 30 defines an inlet 20 for receiving a booklet 14 of rolling paper. The top 28 defines an outlet 22 for dispensing individual sheets of rolling paper 16. The cover 18 has an inner periphery 32 which defines an inner rim 24. The cover 18 has an outer rim 26. The bottom 30 defines the inlet 20 to enable the booklet 14 of rolling papers to enter into the enclosure 18 through the bottom 30. The outer rim of the cover slidably engages the slots of the box and slides to open and close, whereby rolling paper may be dispensed through the top outlet of the cover when the cover is closed.

Support for dispensing rolling paper when the cover is closed is found on page 4, lines 27–29, which states that rolling paper is dispensed when the cover functions as a box cover. Support is also found in FIG. 3.

Support for the terms open and closed is found on page 5, lines 11–13, where the box is closed in a first position where the cover seals the box and is open in a second position where the cover overhangs a portion of the box.

The inlet 20 is rectangular in shape and sized to receive the booklet 14 of rolling paper. The size of the inlet 20 is less than 6 square inches. Preferably, the inlet has a with "w" of between 1" to 2" and a length "l" of between 2" to 3". The outlet 22 is configured in a generally rectangular shape to dispense rolling papers. It can be appreciated, however, that the shape of the outlet 22 may be modified, for example, with rounded ends or edges.

The inner rim 24 is integrated with the inner periphery 32 and is sized to press-fit the booklet 14 of rolling paper within the inlet 20. The cross-sectional shape of the inner rim 24 is rectangular, extending fully around the inner periphery 32 of the cover 18 to optimize contact between the inner rim 24 and edges of the rolling paper booklet 15.

The outer rim 26 extends outwards from the cover 18. The outer rim having a generally uniform thickness "t" for sealing the box. The outer rim 26 also functions as a pedestal for supporting the dispenser 10 when the dispenser 10 is used without the box. When the dispenser 10 is used without the box 12, an operator holds the outer rim 26 while pulling individual sheets of rolling paper 16 from the dispenser 10.

The inner rim and outer rim are co-planar to provide rigidity to the cover 18. This co-planar alignment inhibits flexion of the cover 18 when sheets of rolling paper 16 are dispensed and when the cover functions as a box cover.

The box 12 has an interior 38 and slots 36. The slots 36 are parallel and oppose each other to receive edges of the outer rim 26. The outer rim 26 has smooth edges for slidably engaging the slots 36. The box 12 includes a divider 34 which forms two partitions within the interior 38 of the box.

Figure 2:
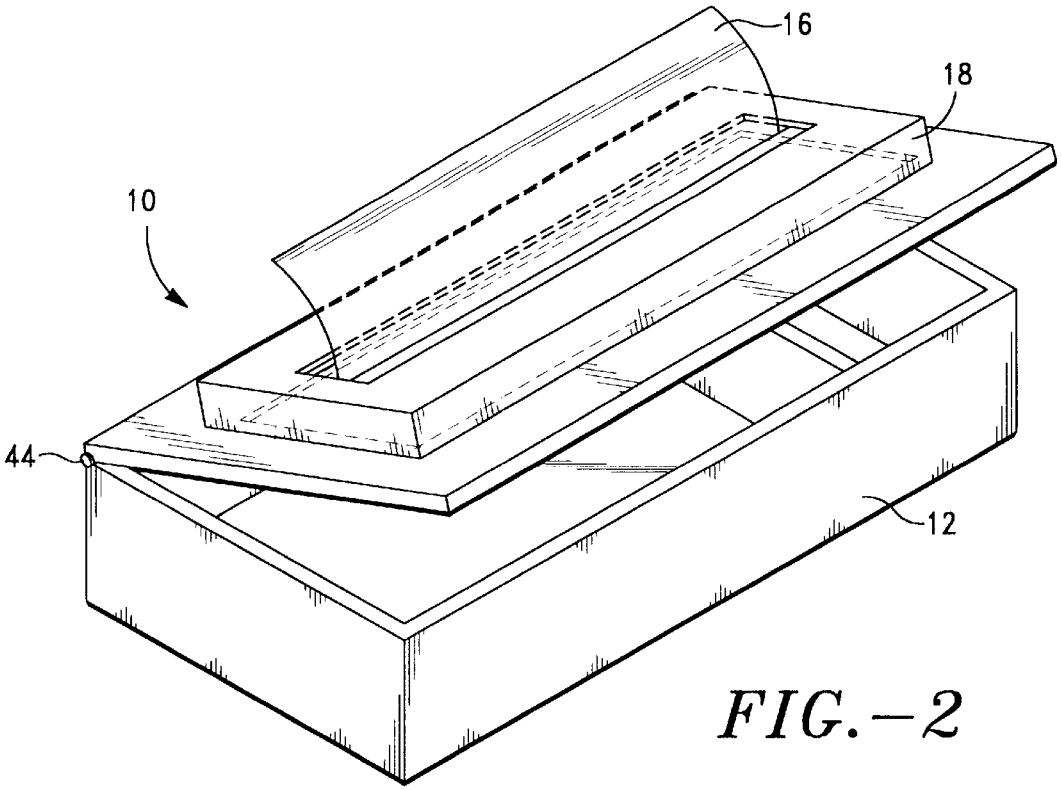
FIG. 2 is a perspective view of a variation of the rolling paper dispenser of FIG. 1 having a folding cover.

FIG. 2 shows a variation of the present invention wherein the cover 18 includes a hinge 44 which foldably attaches the cover 18 to the box 12.

Figure 3:
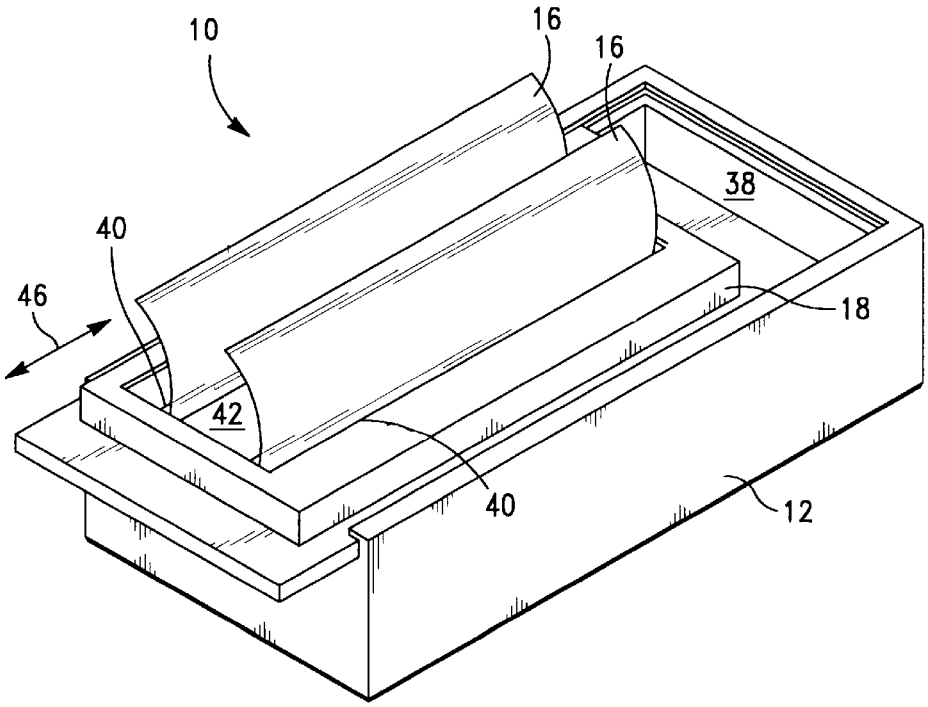
FIG. 3 is perspective view of a variation of the rolling paper dispenser of FIG. 1.

FIG. 3 shows a variation of the invention where the enclosure 18 defines a pair of outlets 40 and a central support 42 for dividing the two outlets 40. This variation of the invention accommodates rolling paper booklets which dispense rolling paper from two locations.

The cover 18 slidably attaches to the box to reciprocate in the directions of the arrows 46 between a first position where the cover seals the box 12 to a second position wherein the cover 18 overhangs a portion of the box 12.

The inlet 20 of the cover faces the interior 38 of the box 12 when the cover 18 seals the box 12. The divider 34 (see FIG. 1) prevents the booklet 14 from falling into the interior 38. In the second position the cover 18 extends beyond the 12 to enable insertion and removal of the rolling paper booklet 14 into and out from the cover 18.

According to one aspect of the invention, the box 12 is wood to minimize fluctuations of humidity in the box 12. The cover 18 is plastic to optimize durability of the cover 18 and to optimize cover rigidity.

This detailed description describes only a few embodiments of the present invention. It can be appreciated that this description is not intended to limiting the present invention to only the embodiments shown. With variations in mind, the invention is to be limited only by the following claims.

We claim:

1. A rolling paper dispenser, comprising:

a box for storing tobacco, the box has slots for receiving a slidable cover;

a cover for closing the box and for holding rolling paper, the cover defining an inner periphery, an inner rim, an outer rim, a top, and a bottom, the cover having an inlet defined on the bottom, and an outlet defined on the top;

the inlet being sized to receive a booklet of rolling paper;

the outlet being configured to dispense rolling papers from the booklet of rolling paper;

the inner rim being integrated with the inner periphery and being sized for holding a booklet of rolling paper; and the outer rim of the cover slidably engages the slots of the box and slides to open and close, whereby rolling paper may be dispensed through the top outlet of the cover when the cover is closed.

2. A rolling paper dispenser as set forth in claim 1, wherein the inner rim extends fully along the inner periphery to enable a rolling paper booklet to press-fit against the rim.

3. A rolling paper dispenser as set forth in claim 1, wherein the inner rim and outer rim are co-planar.

4. A rolling paper dispenser as set forth in claim 1, wherein the outer rim is smooth for slidably engaging a box.

5. A rolling paper dispenser as set forth in claim 1, wherein the inlet has an area of less than 6 square inches.

6. A rolling paper dispenser as set forth in claim 1, wherein the inlet has a width of between 1" and 2" and a length of between 2" and 3".

7. A rolling paper dispenser as set forth in claim 1, where the box has an interior with a divider, whereby when the cover holds a booklet of rolling paper, the divider prevents the booklet from falling into the interior of the box.

8. A rolling paper dispenser, comprising:

a wooden box for holding tobacco, the box includes a cover attachment means;

a sliding cover, the cover being slidably attachable to the attachment means, the cover defining an inner periphery, an inlet, and an outlet, the inlet is rectangular and sized to receive a booklet of rolling paper, the inlet has a width of between 1" and 2" and a length of between 2" and 3";

the outlet configured to dispense rolling papers from the booklet of rolling paper when the cover is closed; and the inner periphery includes an inner rim which extends fully along the inner periphery for holding a booklet of rolling paper.

* * * * *